US005837168A

United States Patent [19]

Rowe

[11] Patent Number: 5,837,168

[45] Date of Patent: Nov. 17, 1998

1

[54] FOAM GENERATING APPARATUS

[76] Inventor: Carroll G. Rowe, P.O. Box 69, Washington, Ark. 71862

[21] Appl. No.: 759,888

[22] Filed: Dec. 3, 1996

[51] Int. Cl.[6] ..... B01F 3/04

[52] U.S. Cl. ..... 261/78.2; 261/DIG. 26

[58] Field of Search ..... 261/DIG. 26, 76, 261/78.2

[56] References Cited

U.S. PATENT DOCUMENTS

| | | | |
|---|---|---|---|
| 1,798,345 | 3/1931 | Wager | 261/DIG. 26 |
| 2,213,122 | 8/1940 | Gohre | 261/DIG. 26 |
| 2,988,151 | 6/1961 | Dion-Biro | 169/14 |
| 3,618,856 | 11/1971 | Sachulk | 261/DIG. 26 |
| 3,701,482 | 10/1972 | Sachnik | 239/590.3 |
| 3,703,345 | 11/1972 | Giesemann | 425/4 |
| 3,836,076 | 9/1974 | Conrad et al. | 239/8 |
| 3,946,947 | 3/1976 | Schneider | 239/401 |
| 4,040,975 | 8/1977 | Wittersheim | 252/239 E |
| 4,213,936 | 7/1980 | Lodrick | 261/DIG. 26 |
| 4,278,132 | 7/1981 | Hostetter | 169/13 |
| 4,366,081 | 12/1982 | Hull | 261/DIG. 26 |
| 4,474,680 | 10/1984 | Kroll | 252/307 |
| 4,492,525 | 1/1985 | Bilyeu | 417/34 |
| 4,505,431 | 3/1985 | Huffman | 239/428 |
| 4,630,774 | 12/1986 | Rehman et al. | 239/8 |
| 4,729,434 | 3/1988 | Rohrbach | 169/24 |
| 4,802,630 | 2/1989 | Kromrey et al. | 239/428 |
| 4,830,790 | 5/1989 | Stevenson | 261/18.1 |
| 4,869,849 | 9/1989 | Hirose et al. . | |
| 4,981,178 | 1/1991 | Bundy | 169/9 |
| 5,012,979 | 5/1991 | Williams | 239/416.5 |
| 5,096,389 | 3/1992 | Grady | 417/364 |
| 5,134,901 | 8/1992 | Grady | 74/606 R |
| 5,275,763 | 1/1994 | Fukai | 417/34 |
| 5,364,031 | 11/1994 | Taniguchi et al. | 239/330 |
| 5,398,765 | 3/1995 | Worthington | 169/52 |
| 5,492,655 | 2/1996 | Morton et al. | 261/76 |
| 5,538,027 | 7/1996 | Adamson et al. | 137/7 |

FOREIGN PATENT DOCUMENTS

| | | | |
|---|---|---|---|
| 448489 | 6/1936 | United Kingdom | 261/DIG. 26 |
| 490186 | 8/1938 | United Kingdom | 261/DIG. 26 |

OTHER PUBLICATIONS

Martin Gardner, "Entertaining Science Experiments with Everyday Objects," 1981, pp. 108–109.

Brochure, "Firecracker by Marco," Newkirk, OK, 2 pgs. undated.

Brochure, untitled, Magee Fire Equipment, Inc., Mesquite, TX Oct. 10, 1994, 4 pgs.

Brochure, "The Mallory Compressed Air Foam System (CAFS)," The Mallory Company, Kelso, WA, 3 pgs, undated.

Brochure, "NK60–FM180–CH25 CAF Pump Unit," Pneumax, Peoria, AZ, 6 pgs, undated.

"Class A Foam and Foam Systems," David Abernathy, Pittsburg, TX, 19 pgs, undated.

"Low–volume, medium–expansion foam nozzle . . . from your workshop," *Fierquip,* vol. 8 No. 1 (1992), US Dept. of Interior.

*Primary Examiner*—Tim R. Miles

*Attorney, Agent, or Firm*—Ray F. Cox, Jr.

[57] ABSTRACT

Apparatus for generating foam for use in fire fighting having two plates housed in a chamber which respectively introduce pressurized air and water/soap solution into the space between the two plates where foam is generated and emitted from an aperture on the side of the chamber. Pressurized water/soap solution is introduced through an orifice into a small opening through one plate. Pressurized air is introduced into the other plate through a number of channels bored through the plate to an annular grove on the surface of the plate. The plates are provided with flat surfaces which are brought together to form a narrow gap. The narrow gap balances the pressure between the incoming water and the incoming air by achieving an equilibrium at some particular radius out from the center of the two plates. This equilibrium radius moves in and out from the center as necessary to keep the two pressures balanced. The incoming air pressure is set at a desired level, and the incoming water pressure is adjusted to a slightly higher initial pressure. The quality of the foam is then determined by further upward or downward adjustments of the water pressure.

7 Claims, 3 Drawing Sheets

FOAM GENERATING APPARATUS

BACKGROUND OF THE INVENTION

The present invention relates to devices for generating foam for use in fire fighting and specifically to a foam generator which provides for automatic balancing of pressure differentials between incoming pressurized water and pressurized air.

Foam generators utilizing pressurized water and pressurized air in combination with a surfactant are useful in fire fighting. There are certain well known means of mixing air, water, and a surfactant to generate foam, including mixing chambers, venturis, and nozzles.

U.S. Pat. No. 4,981,178 issued to Bundy on Jan. 1, 1991 discloses an apparatus for generating fire fighting foam using a mixing chamber.

U.S. Pat. No. 4,505,431 issued to Huffman on Mar. 19, 1985 for "Apparatus for Discharging Three Commingled Fluids" and U.S. Pat. No. 4,474,680 issued to Kroll on Oct. 2, 1984 for "Foam Generating Apparatus and Method" disclose venturi type foam generators.

It has been very difficult in the past to produce a simple device for generating foam from the mixing of pressurized air and pressurized water. (The foam also requires the presence of a soap or surfactant which is introduced into the water prior to the foam generator.) Pressure balancing between incoming pressurized air and incoming pressurized water requires elaborate measures to control both the air volume and pressure and the water volume and pressure. It has generally been necessary to use very complicated devices to balance the volumes and pressures or to require the operator to manually adjust the volumes and pressures on a continuous basis to maintain a balance. If a balanced pressure is not maintained, the quality of the foam being generated can be affected. Various types of foam may be desirable for particular applications. In some situations a dry foam is desirable; in other situations, a wetter foam is desirable. Too much water or too much air can result in a foam that is not efficient for the intended purpose. For example, in some situations, the most desirable type of foam contains sufficient moisture to aid in smothering a fire while it is sufficiently dry to cling to surfaces. If a balanced pressure and volume of water and air is not maintained, the result can be a foam that is either too wet or too dry or that has other deficiencies with respect to the desired quality. The volume of water in relation to the volume of air determines the consistency of the generated foam, so the control of both pressure and volume is necessary to assure the desired foam quality.

The prior art emphasizes the importance of maintaining balanced pressures between the water and air supplies. Bundy, at column 3, beginning at line 12, discusses the problem of achieving the proper combination of air pressure and volume with water pressure and volume to achieve the desired quality of foam. Bundy also discusses the desirability of maintaining equal pressure in the air and water supplies.

The prior art has addressed the problem of balancing the air and water supply pressure in a foam generator by various expedients as mentioned above. Even with the fairly complex and expensive means employed, the operation of a foam generating apparatus for fire fighting requires the services of an experienced operator and even then much experimentation is necessary. For example, even the simple act of changing a hose attached to the apparatus often requires difficult and time consuming rebalancing of the system.

The prior art has shown that control of the air volume at a specific air pressure is the more difficult of the two incoming streams to regulate. It is therefore desirable to set the air pressure and regulate only the water pressure.

It has been suggested that a high degree of turbulence may contribute to the quality of foam produced in that a finer foam structure is obtained. It may therefore be desirable to both balance the pressures of the incoming water and air and do so in a way that maximizes turbulence.

The problems and limitations of the prior art are overcome by the present invention as summarized below.

SUMMARY OF THE INVENTION

The present invention is an apparatus for generating foam for use in fire fighting. Pressurized water (including a surfactant) and pressurized air are introduced in such a way as to automatically achieve the desired balance between water and air pressures while producing a highly turbulent environment which conduces to the formation of a high quality foam.

Certain basic principles are known to affect the production of quality foam. Air is introduced into a chamber at a given pressure which must be greater than the backpressure due to foam in the outlet hose; otherwise air could not enter the chamber. It must be understood that there will be a definite amount of water in a given amount of foam of a given consistency exiting a given hose size at a given pressure. If water is introduced at a pressure greater than the pressure of incoming air, it will displace air from entering the chamber. The incoming water (so long as its pressure is greater than the incoming air) can be orificed to deliver the amount of water to produce foam of a specified quality and quantity. Then variation of the water pressure will produce varying volumes of water entering the chamber and therefore varies the consistency of foam. The air of course occupies the volume of the hose not occupied by the water (recognizing that the volume of air is affected by the pressure of the incoming air and its compressible nature). If the air and water are at the same pressure, mixing will occur.

The pressures of the incoming water and air derive from two components: a static or head pressure, and a dynamic pressure due to the velocity of the flowing water and air. The present invention focuses on the dynamic pressure as a means to both balance the incoming water and air and to achieve a highly turbulent environment conducive to excellent foam quality. It is surmised in the present invention that balancing the incoming water and air pressures requires the rapid diminishing and deadening of the velocity of the incoming streams of water and air and therefore the concomitant loss of the dynamic pressure of both the water and air streams until the water and air pressure each assume the pressure of the mixing chamber (which in turn is determined by atmospheric pressure, back pressure in the hose, etc.). At this point the pressures are balanced and the energy of the lost velocity of the incoming air and water streams is converted into turbulence.

In order to achieve this rapid conversion of the dynamic pressures of the incoming water and air into turbulent energy, the incoming water and air streams should be directed onto a surface which stops or splatters the streams. In addition to balancing the water and air pressures, the "splattering" effect also produces the highly desirable turbulent environment and separates the incoming water into fine droplets to speed mixing with the incoming air.

There are various methods to accomplish this velocity deadening of the incoming water and air streams. An orifice with a water stream directed into an elbow with air introduced from the side of the elbow between the orifice and the turn of the elbow would be satisfactory in smaller hose configurations. The same effect would be accomplished by introducing the water onto the surface of a flat plate.

In the preferred embodiment of the invention, the heart of the device is two plates housed in a chamber which respectively introduce pressurized air and water into the space between the two plates where foam is generated and emitted from an aperture of the chamber.

The pressurized water is introduced through an orifice into an opening through one plate. The pressurized air is introduced into another plate through a number of channels bored through the plate to an annular grove placed on the surface of either plate. While introducing the pressurized air into an annular groove is not necessary to the practice of the present invention, it does serve to improve mixing of the water and air by producing still more turbulence upon exit of the water and air from between the two plates.

In the preferred embodiment, the two plates are provided with flat surfaces, and when in operation, are in close proximity to each other. The narrow gap provides part of the mechanism that helps to equalize the pressure between the incoming water and the incoming air. It appears that the two pressures balance themselves by achieving an equilibrium at some particular radius out from the center of the two plates. This equilibrium radius appears to move in and out from the center as necessary to keep the two pressures balanced. Preferably the two plates are placed in such proximity that the velocity of the pressurized water would produce a negative pressure and in fact tend to draw the two plates together to a very narrow gap if the plates were not fixed at a set distance. By placing the two plates in such close proximity, the turbulence is significantly enhanced.

The water/soap solution and the air will intermingle in this gap in a highly turbulent fashion, and upon exiting the gap will produce a foam. The consistency of the foam can be adjusted by the operator by adjusting either the incoming water pressure or the incoming air pressure. In the preferred embodiment, however, the incoming air pressure is set at a desired level, and the incoming water pressure is adjusted to a slightly higher initial pressure. The consistency of the foam is then determined by further upward or downward adjustments of the water pressure.

It is therefore an object of the present invention to provide for a self balancing foam generating mechanism using pressurized water and pressurized air.

A further object of the present invention is to provide for a foam generating mechanism using pressurized water and pressurized air which is simple and economical to construct and easy to operate.

An additional object of the present invention is to provide for a foam generating mechanism using pressurized water and pressurized air which produces varying qualities of foam and accepts varying lengths and types of hoses without requiring complicated and delicate rebalancing of air and water pressures.

A still further object of the present invention is to provide for highly turbulent mixing of the pressurized water and air to produce an exceptionally high quality foam.

Further objects and advantages of the present invention will be apparent from a consideration of the following detailed description of the preferred embodiments in conjunction with the appended drawings as briefly described following.

DETAILED DESCRIPTION OF THE PREFERRED EMBODIMENTS

Figure 1:
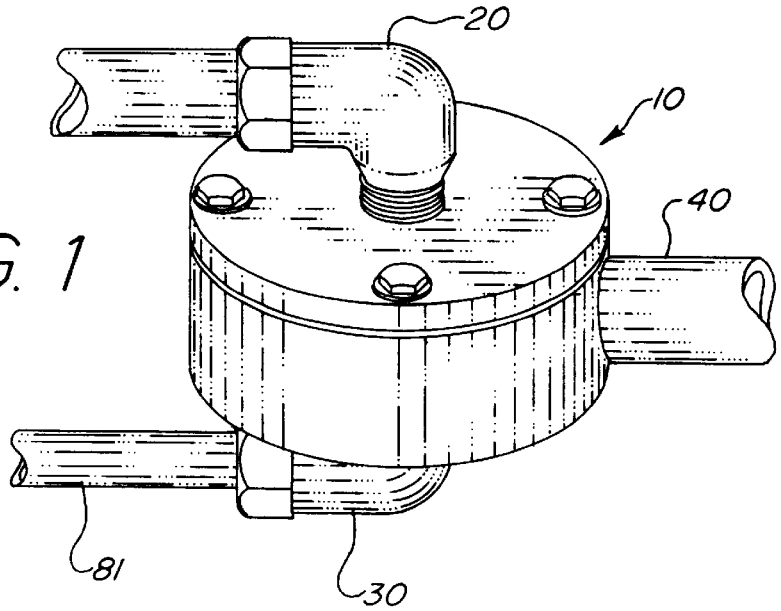
FIG. 1 is an exterior perspective view of a chamber containing the foam generating plates and having incoming lines for pressurized water and air and an exit for foam generated in the chamber.

The present invention may be described with reference to FIGS. 1 and 2. A chamber 10 is provided which accepts an incoming pressurized water line 20 and pressurized air line 30. Foam generated in the chamber 10 exits through the outlet 40.

The heart of the present invention is found in the provision for two plates 50, 60 where the incoming water and air, respectively, are introduced to each other. The shape of the chamber 10 in which the foam is generated is not critical to the invention, although the chamber 10 should allow space around the plates 50, 60 for the generated foam to exit. Furthermore, it is desirable to avoid shaping the chamber 10 such that a spiraling action is induced in the foam. Such action can separate foam into its primary constituents by centrifugal force.

The pressurized water plate 50 is simply a circular disc 51 with a bore 52 through the center for the introduction of pressurized water to a gap 70 between the plates 50, 60. The bore 52 may be reduced by an orifice for better control of the pressure and for adjustment of the volume of the incoming water. As will be discussed hereinafter, the pressurized water contains an admixture of surfactant which is introduced to the pressurized water prior to the chamber 10 by various means well known in the art.

Figure 2:
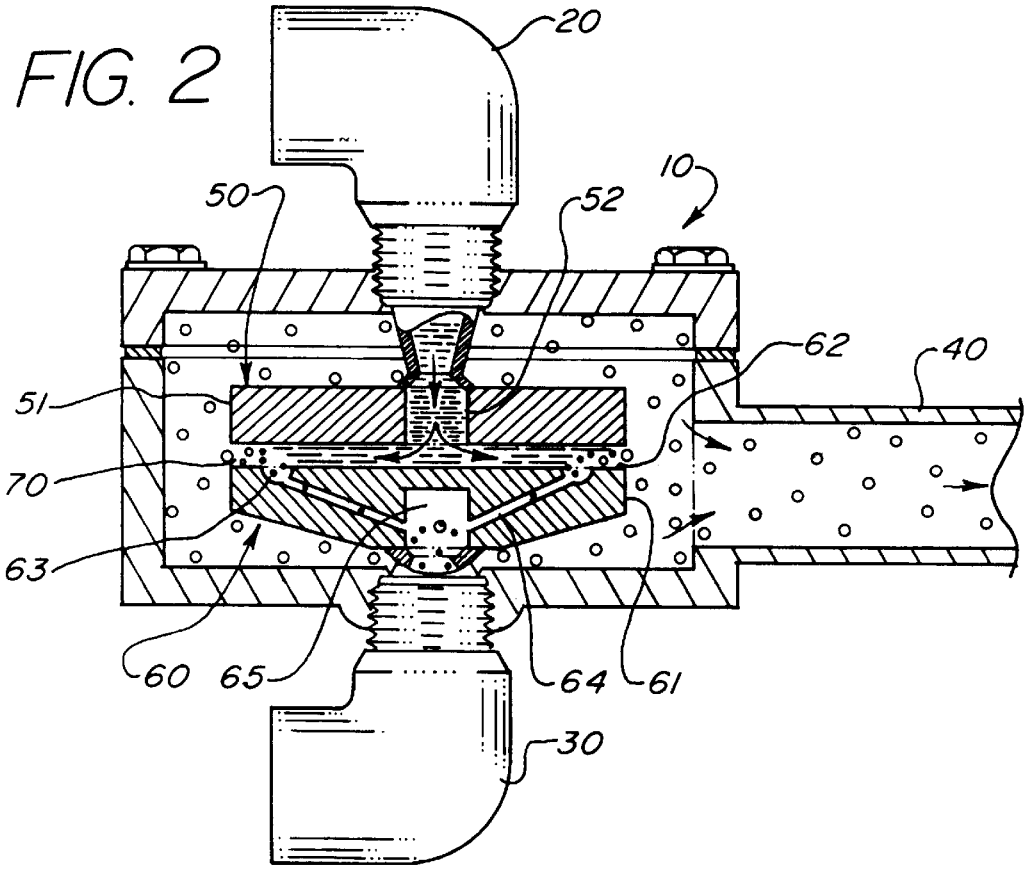
FIG. 2 is a sectional elevation view of the chamber of FIG. 1 showing the pressurized water plate and the pressurized air plate located to the top and bottom respectively of the chamber with the foam generating gap therebetween.
Figure 3:
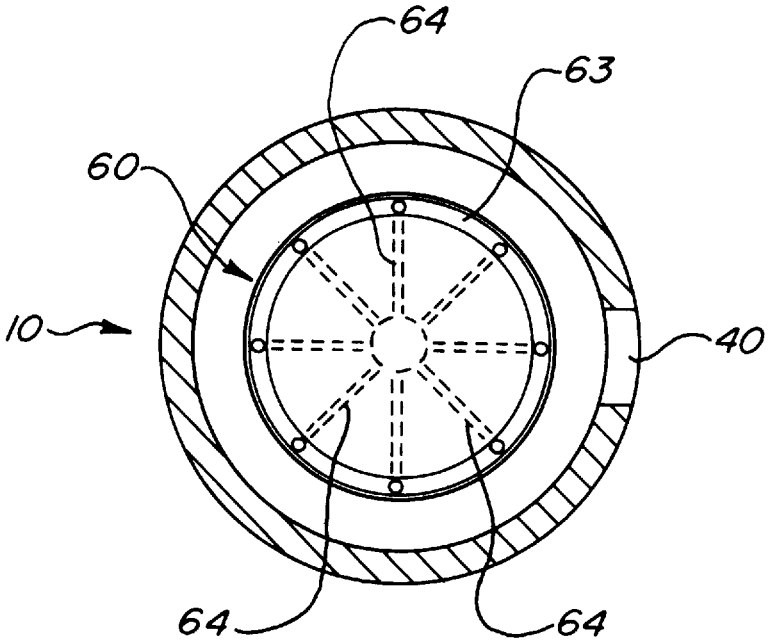
FIG. 3 is a sectional plan view of the chamber showing the pressurized air plate and the annular groove thereon.

As shown in FIGS. 2 and 3, the pressurized air plate 60 is likewise a circular disc 61 having a gap-facing surface 62 on which an annular groove 63 is disposed on the surface 62 and may be located at various radial distances from the periphery of the surface 62. In some embodiments, it may be desirable to place surface roughening features such as ripples or grooves between the annular groove 63 and the periphery of the surface 62 in order to enhance turbulence and mixing. The annular groove 63 is fed pressurized air from a plurality of radial passages 64 communicating with an inlet bore 65. The inlet bore 65 in turn communicates with the incoming pressurized air line 30. Alternatively, the radial passages 64 may be replace by a plenum receiving pressurized air and communicating with the annular groove 63 by simple openings. When a plenum is employed it may be desirable to have the pressurized air enter the plenum at right angles to the openings communicating with the annular groove 63 in order to ensure an even pressure among the openings and therefore at all points on the annular groove 63.

Figure 4:
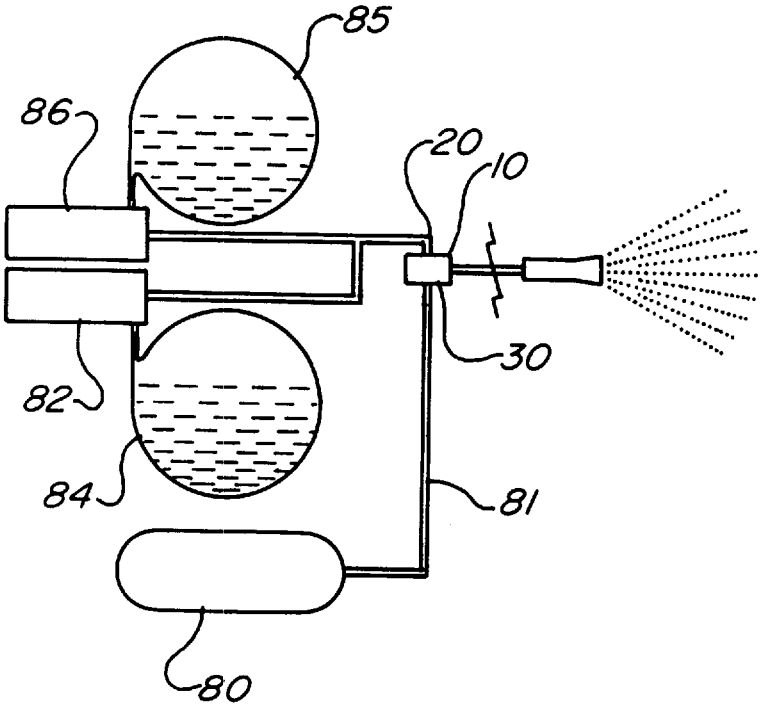
FIG. 4 is a schematic diagram showing the components of a complete foam generating system employing the present invention.

FIG. 4 is an overall schematic of a complete system incorporating the present invention showing an air compressor 80 connected by air line 81 leading to the air inlet 30 of the chamber 10, and a water pump 82 connected to water reservoir 84 and to water line 83 leading to the water inlet 20 of the chamber 10. Not shown are valves in the air line 81 and the water line 83 for setting the volume and pressure of the incoming water and air. Also shown in the schematic is a soap reservoir 85 and dispenser 86 into the water inlet line 83.

Figure 5:
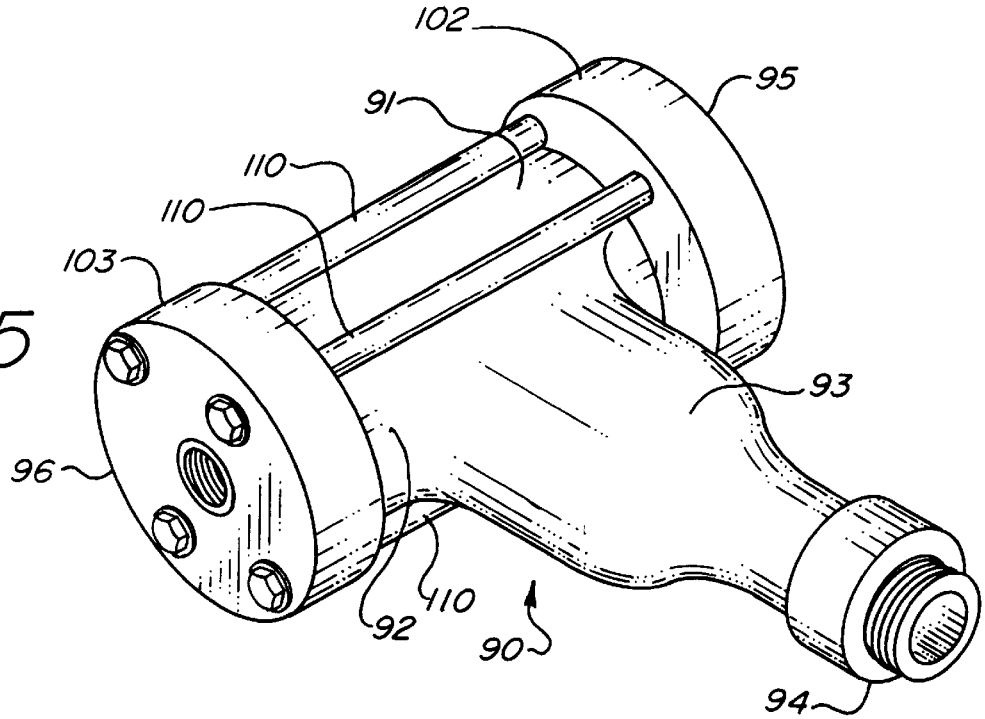
FIG. 5 is a perspective view of an alternative embodiment of the present invention for use in high pressure situations in which the plates are carried on respective plugs which are held to the chamber by bolts.
Figure 6:
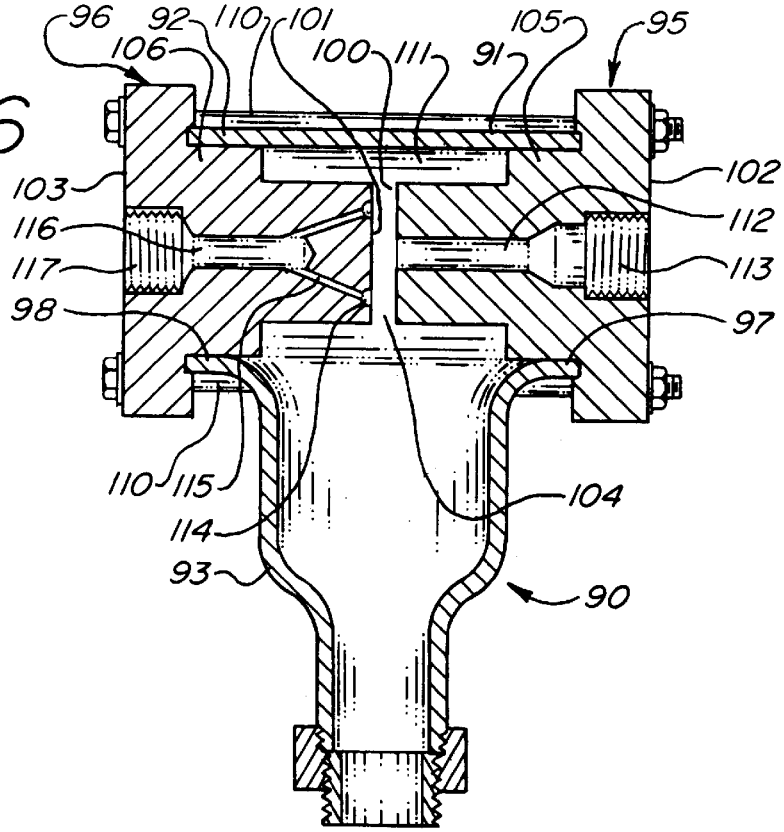
FIG. 6 is a sectional view of the embodiment of FIG. 5.

FIGS. 5 and 6 show a preferred embodiment of the present invention. There are three primary pieces to the preferred embodiment of the foam generator of the present invention. The assembled foam generator is shown in perspective in FIG. 5. First, there is a housing 90, which is preferably constructed of stainless steel. The housing is a T-shaped hollow chamber having an water inlet section 91 and air inlet section 92 across the top of the "T" and a foam outlet section 93 at the base of the "T". The foam outlet section 93 at the base of the T-shaped chamber is reduced to a pipe which is the nozzle opening 94 or connection point for a hose. While the prior art normally uses the hose as part of the foam generating apparatus, the present invention requires only a minimal length of hose. Foam is generated in the housing 90 and available in close proximity to the nozzle opening 94.

Fitting into the housing 90 are two plugs 95, 96, preferably of plastic, which fit in respective open ends 97, 98 of the water inlet section 91 and air inlet section 92, respectively, at the top of the T of the housing 90. These two plugs 95, 96 incorporate the plates 100, 101, which introduce pressurized water and air into the gap 104 between the two plates 100, 101.

A section of the embodiment of FIG. 5 showing the two plates 100, 101 is given in FIG. 6. Each plug 100, 101 is provided with a flange 102, 103, respectively, which fits against the respective open ends 97, 98, and serve to fix the plugs into position so as to form a gap 104 of the requisite width. Each plug 95, 96 is reduced to a middle section 105, 106 sized to fit tightly in either open end 97, 98. Each plug is further reduced to an inner section 107, 108. When the two plugs 95, 96 are assembled into the housing 90, the gap 102 between the two plugs 95, 96 is set at the desired distance.

Plate 100 introduces pressurized water into the gap 102 through a bore 112 which is connected to the inlet water supply by an integral water inlet connection 113. Likewise, plate 101 introduces pressurized air into the gap 102 through an annular groove 114 fed by radial passages 115 from an inlet bore 116 provided with an integral air inlet connection 117. The generation of foam is otherwise identical to that described above for the embodiment of FIGS. 1–4.

A device sized to deliver foam to a 1 ½ inch hose from a 100 psi water supply and 100 psi air supply would have inlets 91, 92 about 3 inches in diameter. The foam outlet section 93 at the base of the T-shaped chamber is reduced to a pipe approximately the diameter of the hose. In this sized embodiment, the outermost part of each flange 102, 103 is about 6 inches in diameter. Each plug 95, 96 is reduced to a 3 inch diameter middle section 105, 106 to fit tightly in either open end 97, 98. Each plug is further reduced to an inner section 107, 108 of about 2 inches in diameter. In this embodiment, when the two plugs 95, 96 are assembled into the housing 90, the gap 102 between the two plugs 95, 96 is preferably about 3⁄16 inch.

As shown in FIGS. 5 and 6, the two plugs 95, 96 are held to the housing 90 by four bolts 110 through holes in the flanges 102, 103. Although not critical, it is desirable that a space 111 be left around the plates 100, 101 and the gap 102 to allow the free exit of foam generated between the plates 100, 101.

The mechanism by which the present invention balances the incoming water and air pressures is believed to be as follows. It is surmised that balancing the incoming water and air pressures requires the rapid diminishing and deadening of the velocity of the incoming streams of water and air and therefore the concomitant loss of the dynamic pressure of both the water and air streams until the water and air pressure each assume the pressure of the mixing chamber (which in turn is determined by atmospheric pressure, back pressure in the hose, etc.). At this point the pressures are balanced and the energy of the lost velocity of the incoming air and water streams is converted into turbulence.

In order to achieve this rapid conversion of the dynamic pressures of the incoming water and air into turbulent energy, the incoming water and air streams should be directed onto a surface which stops or splatters the streams. In addition to balancing the water and air pressures, the "splattering" effect also produces the highly desirable turbulent environment and separates the incoming water into fine droplets to speed mixing with the incoming air.

An orifice with a water stream directed into an elbow with air introduced from the side of the elbow between the orifice and the turn of the elbow would be satisfactory in smaller hose configurations. The same effect is accomplished in the preferred embodiment described above by introducing the water onto the surface of the flat plate.

Incoming air pressure is set to a fixed level by any means of air pressure regulator well known in the art. The incoming water pressure is set to a level slightly in excess of the incoming air pressure. The difference is not critical so long as the water pressure exceeds the air pressure. The pressure at the periphery of the plates is determined by the outlet back pressure due to the chamber size, the hose, nozzle, and any orifice or restriction in the outlet side of the system. The pressure at the center of the plates is determined by the regulated inlet water pressure, and the pressure available at the annular grooves is determined by the inlet regulated air pressure. The back pressure at the periphery of the plates is at some level higher than atmospheric, but lower than either the pressure at the water inlet or the air inlet. Air is of course compressible, while water is not. It is believed therefore that due to the lower air pressure and the compressibility of the air, a balanced pressure between the air and water is reached at some radial point between the air inlet at the annular groove and the water inlet at the central bore. This radial equilibrium point will shift radially between the air and water inlets depending on the incoming volume and pressure of water, thus automatically balancing the two. As the back pressure changes, the pressure at the balance point will change proportionally. The balancing of the inlet air pressure and the inlet water pressure is therefore automatic without the need for intervention by the user. This mechanism is believed to explain the operation of the present invention but the invention is not limited thereto. Additional adjustment of the mechanism to enhance the quality of the foam is possible through adjustment of the size of the gap between the two plates. Such an adjustment may be made by any means known in the art.

Furthermore, it is desirable that the proximity of the plates be such as to induce a high degree of turbulence into the mixing. This is accomplished by putting the two plates in close proximity. Thus a large proportion of the mixing takes place between the plates and the hose is not as necessary to act as a turbulent mixing chamber. This frees the operator from any problems involved in rebalancing the system when hoses are changed. Furthermore, since the hose is not occupied by unrestricted air, the hose is operating at peak capacity resulting in maximum flow and increased trajectory for the foam exiting from the nozzle of the hose. Better mixing before the hose also allows better foam quality with finer structure when such is desirable.

The present invention also has the advantage that it allows more flexibility in the use of pumps and compressors. As an example, one large pump might supply several foam lines independently of each other. Oversize pumps and compressors may be utilized without alteration. The present invention allows the air pressure to fluctuate which enables the compressor to cycle without adverse effect on the foam.

Although the preferred embodiment has been described with respect to a version of the present invention in which two plates are used and each plate introduces only water or air to the gap between for mixing. An alternative embodiment may employ two plates in which one plate serves as the impingement surface and the other plate contains passages for introducing both pressurized air and a pressurized solution of water and surfactant. This arrangement utilized the same principles for operation, but may have advantages allowing a compact design.

The present invention has been described with reference to certain preferred and alternative embodiments which are considered exemplary only and not limiting to the full scope of the invention as set forth in the appended claims.

What is claimed is:

1. An apparatus for generating foam, comprising:

means for introducing a solution of pressurized water and surfactant into a chamber;

means for introducing pressurized air into said chamber; and means for rapidly reducing the velocity of the solution of pressurized water and surfactant and for rapidly reducing the velocity of said pressurized air upon entering said chamber;

wherein said means for rapidly reducing said velocity of said solution of pressurized water and surfactant and for rapidly reducing said velocity of said pressurized air upon entering said chamber comprises:

a first plate having an inner surface and having a central bore through said first plate and further having means for introducing through said central bore said solution of pressurized water and a surfactant to said inner surface; and a second plate having an inner surface fixed in spaced relationship to said inner surface of said first plate forming a gap having a determined distance between said inner surface of said first plate and said inner surface of said second plate, an annular groove disposed on one of said inner surfaces of said first or second plate and having means for introducing pressurized air to said annular groove.

2. The apparatus of claim 1 wherein said determined distance of said gap is set so that a negative pressure drop exists in at least a portion of the region between said central bore and said annular groove and between said first plate and said second plate.

3. The apparatus of claim 1 wherein said determined distance of said gap is set so that a negative pressure drop exists in at least a portion of the region between said annular groove and the peripheries of said first plate and said second plate.

4. The apparatus of claim 1 having surface roughening means disposed on at least one of said inner surfaces of said first and second plates.

5. The apparatus of claim 1 wherein said chamber contains said first plate and said second plate and has means to introduce a solution of pressurized water and surfactant to said first plate, means to introduce pressurized air to said first or second plate, and means for allowing foam generated in said chamber to exit said chamber.

6. The apparatus of claim 5 further comprising means to set the inlet pressure to said chamber of said solution of pressurized water and surfactant and means to set the inlet pressure to said chamber of said pressurized air.

7. The apparatus of claim 6 further comprising means to adjust said determined distance of said gap.

* * * * *